US007235751B2

(12) United States Patent
Liljestrand et al.

(10) Patent No.: US 7,235,751 B2
(45) Date of Patent: Jun. 26, 2007

(54) ELECTRIC DEVICE, A CURRENT LIMITER AND AN ELECTRIC POWER NETWORK

(75) Inventors: Lars Liljestrand, Västerås (SE); Stefan Valdemarsson, Västerås (SE)

(73) Assignee: ABB AB, Västerås (SE)

( * ) Notice: Subject to any disclaimer, the term of this patent is extended or adjusted under 35 U.S.C. 154(b) by 329 days.

(21) Appl. No.: 10/474,961

(22) PCT Filed: Jan. 10, 2002

(86) PCT No.: PCT/SE02/00034

§ 371 (c)(1),
(2), (4) Date: Oct. 16, 2003

(87) PCT Pub. No.: WO02/056326

PCT Pub. Date: Jul. 18, 2002

(65) Prior Publication Data

US 2004/0245857 A1 Dec. 9, 2004

(30) Foreign Application Priority Data

Jan. 11, 2001 (SE) ..... 0100074

(51) Int. Cl.
*H01H 1/14* (2006.01)
*H01H 1/00* (2006.01)
*H01H 9/00* (2006.01)

(52) U.S. Cl. ..... 200/239; 200/272; 200/274; 307/125; 307/126; 307/143

(58) Field of Classification Search ..... 200/239, 200/272, 274
See application file for complete search history.

(56) References Cited

U.S. PATENT DOCUMENTS 3,430,062 A 2/1969 Roth
3,448,287 A 6/1969 Giammona
4,027,123 A 5/1977 Ihara

*Primary Examiner*—Robert L. Deberadinis
*Assistant Examiner*—Hal I. Kaplan
(74) *Attorney, Agent, or Firm*—Venable LLP; Eric J. Franklin

(57) ABSTRACT

An electric device including an electric switch having a plurality of contact members arranged in series to form a plurality of breaking points arranged in series. One of the contact members at each breaking point is movable. A drive is arranged to actuate each movable contact member. The drive is arranged to effect simultaneous movement of the movable contact members. A commutation circuit is connected in parallel with the electric switch. Each contact member constitutes a part of a contact element, which contact elements are arranged in series. The contact elements have conducting and insulating parts. Every second contact element is movable in relation the others so that movement effects a breaking or closing position of the electric switch. The invention also includes a current limiter such as an electric device and also an electric power network provided with such a current limiter.

25 Claims, 5 Drawing Sheets

ELECTRIC DEVICE, A CURRENT LIMITER AND AN ELECTRIC POWER NETWORK

CROSS-REFERENCE TO RELATED APPLICATIONS

This application claims priority to Swedish patent application 0100074-4 filed 11 Jan. 2001 and is the national phase under 35 U.S.C. § 371 of PCT/SE02/00034.

TECHNICAL FIELD

The present invention relates firstly to an electric device comprising an electric switch having a plurality of contact members arranged in series to form a plurality of breaking points arranged in series, at least one of the contact members at each breaking point being movable, and drive means arranged to actuate each movable contact member.

The invention relates secondly to a current limiter.

The invention relates thirdly to a dynamic voltage restorer.

The invention relates fourthly to an electric power network.

Finally, the invention relates fifthly to use of the current limiter in accordance with the invention.

BACKGROUND ART

Certain types of electrical apparatus in electrical systems are such that they are seldom activated but must be able to be activated quickly when required. The losses of the apparatus contribute to the losses of the system. Admittedly this contribution is rather slight but the losses of the apparatus affect its cost since, in many cases, it must be water-cooled, which is expensive. An apparatus dimensioned for continuous high power also incurs high costs.

With the objective of overcoming these drawbacks it is already known to use a commutation contact to bypass these types of apparatus. The apparatus therefore need not be dimensioned for a continuous current, but only for brief surges. A high power in the apparatus can then be accepted for a short time since it automatically has a thermal buffer in the form of the masses always present. The apparatus can thus operate without water-cooling. This, together with the slimmer dimensioning, enables great savings.

Important examples of apparatus of these type are current limiters and breakers. However, the invention is not limited to these applications. Breakers based on power semiconductors are expensive and cause losses. For most of its lifetime a breaker is passively in the on position and conducts current. It is active during extremely short periods when it opens the circuit and breaks the current. In the same way it then stays in open position and later becomes active during a short period when it closes the circuit. While the breaker is in closed state and conducting current it develops power in the form of losses that must be cooled off. In open state the current is zero and the losses are thus also zero.

If a commutation contact is connected in parallel with the semiconductor breaker, the commutation contact will conduct all current when the breaker is in closed state. When the circuit is to be broken, the commutation contact opens first and commutates all current over to the semiconductor breaker. The current in the commutation contact becomes zero and it is in open position. The semiconductor breaker can now become active and break the current in the circuit.

A breaker and a current limiter have in principle the same function apart from the speed with which they break the current. A breaker breaks at the current's zero crossing whereas the current limiter intervenes earlier and breaks an extremely high current.

Similarly a commutation contact can be used for several applications involving apparatus with high losses but which are only active for brief periods. A current limiter may consist of an electric switch parallel-connected to a commutation circuit to which the current is commutated when the electric switch breaks. During normal operating conditions, thus, the current is thus permitted to flow through the electric switch without losses. In the event of a fault causing the current to increase strongly the electric switch will commutate the current over to the parallel branch. This must take place extremely fast. The stipulation for commutating current from one branch to another is that a voltage must be generated in the branch conducting the current. The amplitude of the voltage required depends on the amplitude of the current at the instant when commutation is to occur, on the impedance in the parallel branch to which the current shall be commutated and on the duration of the commutation process. The commutations process must take place fast in order to minimise power development in the commutation apparatus and thus the damages or the dimensioning of the commutation apparatus. The commutation is facilitated if it can be delayed until the natural zero crossing of the current in alternating current networks. A mechanical contact gives lower loses when it conducts current. However, the voltage it can build up when the contacts open is limited to the voltage over the arc formed between the contacts. High arc voltage is a condition for rapid commutation with a mechanical contact.

DESCRIPTION OF THE INVENTION

Against this background, one object of the present invention is to provide an electric device suitable for use in a current limiter and in other contexts requiring equivalent properties in the electric device, e.g. a breaker that utilises semiconductors as breaking elements, or other electrical equipment that utilises semiconductors. From the first aspect of the invention this object is achieved in that an electric device of the type that includes the drive means being arranged to effect simultaneous movement of the movable contact members so that simultaneous breaking is achieved at all the breaking points; a commutation circuit being connected in parallel with the electric switch and each contact member constituting a part of a contact element, which contact elements are arranged in series, a contact surface of each contact element abutting each immediately adjacent contact element, which contact surfaces are substantially flat and parallel, and each contact element comprising at least one conducting part and at least one insulating part. Furthermore, the contact elements are divided into a first and a second group of contact elements, so arranged that every second contact element belongs to the first group and every second contact element belongs to the second group, the contact elements of the first group and the contact elements of the second group being arranged movable in relation to each other in planes parallel with the contact surfaces, between a first position in which conducting part(s) of each contact element is/are in contact with conducting part(s) of the immediately adjacent contact element, and a second position in which the conducting part(s) of the first group of contact elements is/are exposed only to the insulating part(s) of immediately adjacent contact elements in the second group, the drive means being arranged to effect relative movement of the contact elements between said first and second positions.

A high arc voltage is obtained over the electric switch thanks to breaking taking place simultaneous at all the breaking points, thus enabling the switch to be used in applications where this is required. Thanks also to breaking taking place simultaneously at all the breaking points, rapid and reliable commutation occurs through the commutation circuit. A high arc voltage is a condition for commutating a high current.

An electric switch designed in this manner is able to commutate a high current from the electric switch to the commutation circuit. It is advantageous if the losses in the electric power system are reduced, particularly when using apparatus with large losses that are seldom active. Low losses are then obtained even with high currents. The high voltage is maintained even after commutation has taken place. Simultaneous breaking at several breakers connected in series causes several arcs and the voltage drop over the arcs is added to a high total arc voltage, e.g. 100 V, thus enabling the short commutation time, i.e. in the order of less than 1 ms. The short commutation time means that the energy developed only gives rise to very small damages occurring on the electric switch, which is acceptable from the functioning aspect.

The device is primarily intended for high voltages but is not limited thereto. Typical voltage levels are 12–36 kV.

During normal operation the device will be loss-free, as well as being reliable, robust and substantially maintenance-free. The position between the two groups of discs is not sensitive in either closed or open state. This means that contact bounces or mechanical stress due to high retardation at the end positions are eliminated.

In accordance with a preferred embodiment of the electric device according to the invention a drive means is arranged to impart a simultaneous movement to the contact elements of the first group and retaining means are arranged to keep the contact elements of the second group stationary.

Allowing the contact elements of only one group perform the simultaneous movement, while the other group is retained is an alternative that offers a relatively simple and robust construction.

In accordance with another preferred embodiment the movement is a rotary movement and each contact element is in the form of a flat, circular disc, the discs being coaxial. A rotary movement is advantageous for several reasons. It ensures that the drive mechanism will be simple, the device compact and the mass forces relatively low.

In accordance with yet another preferred embodiment each of the contact elements in the first group is mechanically joined at the periphery to a drive means common to these contact elements, and each of the contact elements in the second group is mechanically joined at the centre to a retaining means common to these contact elements.

The drive and retaining means being in the form of a means common to the first and second group, respectively, ensures in a simple manner that the breaking movement occurs simultaneously at all the breaking points. The positioning of the drive and retaining means at the periphery and centre, respectively, enables a simple and reliable driving connection while, at the same time, retaining can be achieved in the simplest possible way.

In accordance with yet another preferred embodiment the angle of rotation between the first and the second position is within the interval $(180°/n)\pm20\%$, preferably $\pm5\%$, where n=the number of conducting parts in a contact element. A rotary angle within this interval ensures that the device is optimised as regards dimensioning in relation to the required distance of movement.

In accordance with a further preferred embodiment the movement is a linear movement and each contact element is in the form of a flat disc.

This may facilitate achieving high cross-sectional area in the conducting parts, which is particularly advantageous at high nominal current strengths.

In accordance with yet another preferred embodiment the insulating part(s) of each contact element in the first and/or second group comprise an opening extending from one side of the disc to the other side.

This embodiment enables an arc distance between the conductor parts in the contact elements of one group to be easily obtained when the electric switch is turned to the breaking position, in which these conducting parts are exposed to the relevant opening.

In accordance with yet another preferred embodiment the number of contact elements is at least five.

As described above, a higher total arc voltage is obtained the larger the number of breaking points in the electric switch. From this point of view, therefore, the larger the number of breaking points, the more advantageous. However, other aspects naturally place practical limits on the number.

As mentioned above, a condition for efficient commutation is that the electric switch breaks rapidly, preferably at a speed of <1 ms.

In accordance with a further preferred embodiment the driving means is connected to a driving power source arranged to effect movement from the first to the second position in less than 1 ms.

Suitable driving sources to achieve such rapid actuation are a mechanical spring, e.g. a torsion spring or alternatively a Thomson coil. Both these types of driving power sources thus constitute preferred embodiments. In another preferred embodiment the driving power source is a conventional electric motor, which may be suitable in applications where a rapid movement is not necessary.

In accordance with another preferred embodiment the number of conducting parts in each contact element is two or more in order to form a plurality of parallel current paths.

A large contact area can then be achieved, with relatively short stroke length for the movement of the movable contact elements.

A second object of the present invention is to provide a current limiter that enables elimination of losses in the form of heat.

This object is achieved in the second aspect of the invention that includes a current limiter of the type that includes an electric device in accordance with the first aspect of the invention.

As stated in the introduction, the electric device is intended for and designed to be incorporated in a current limiter, but is not restricted to this application. The current limiter as claimed thus exhibits advantages equivalent to those described above regarding the claimed electric device and the various preferred embodiments thereof.

In accordance with a preferred embodiment of the claimed current limiter the commutating circuit includes a fuse.

This provides a simple, reliable and robust alternative that fulfils the requirements of the commutation circuit in the current limiter. The drawback is, of course, that it is a disposable component. However, this drawback can be reduced by arranging several fuses in a revolver arrangement. Since the electric switch normally conducts the current no losses will occur in the fuse during operation. The current with only be commutated over to the fuse in the event of a short circuit.

According to an alternative preferred embodiment of the claimed current limiter the commutating circuit includes power semiconductor components. This alternative is suitable in power systems that are subjected to a large number of short-circuits, such as in distribution systems with overhead lines. It is naturally more complicated than the fuse alternative but instead permits repeated operations.

A third object of the invention is to exploit the advantages of the electric device in a dynamic voltage restorer (DVR). This object has been achieved in the third aspect of the invention in that a dynamic voltage restorer that includes an electric device in accordance with the first aspect of the invention.

A fourth object of the invention is to provide an electric power network in which the losses are small.

This object has been achieved according to the fourth aspect of the invention in that the electric power network comprises a current limiter in accordance with the second aspect of the invention and/or a dynamic voltage restorer in accordance with the third aspect of the invention. The fifth aspect of the invention is achieved by the use of such a current limiter and/or dynamic voltage restorer in an electric power network.

The advantages described above in connection with the first and second aspects of the invention are exploited in a power network so designed or in such use.

These advantages may be of particular interest in applications such as distributed generation in electric networks such as industrial networks or in wind power plants as well as electric networks in which distributed energy is generated by solar arrays, gas turbines, fuel cells or other energy sources. Such applications therefore constitute preferred embodiments of the use.

The invention will be explained in more detail in the following detailed description of embodiments by way of example, with reference to the accompanying drawings.

DESCRIPTION OF PREFERRED EMBODIMENTS OF THE INVENTION

Figure 1:
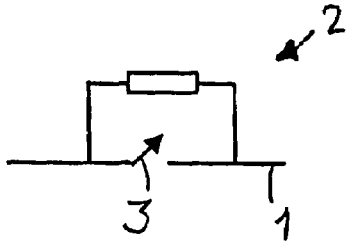
FIG. 1 is a basic layout sketch of an electric device in accordance with the invention.
Figure 3:
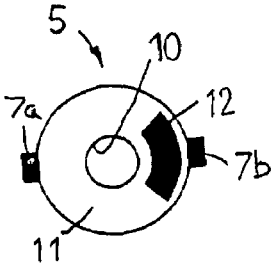
FIGS. 3 and 4 are views from above of a first and a second component in the electric switch shown in FIG. 2, FIGS. 5–7 show the electric switch depicted in FIGS. 2–4 in corresponding sections/views, in breaking position.
Figure 2:
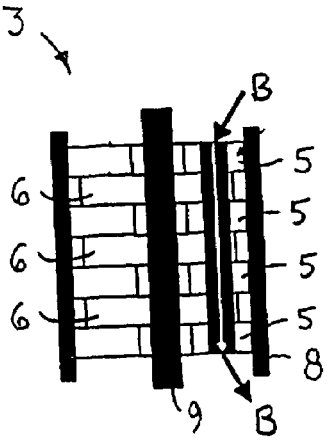
FIG. 2 is an axial section through an electric switch as shown in a first example of the invention, with the switch in closing position.
Figure 4:
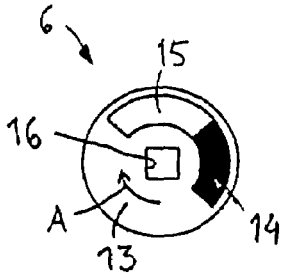

FIG. 1 shows an electric conductor 1 provided with a current limiter comprising an electric device in accordance with the invention. The electric device consists of an electric switch 3 and a commutation circuit 2 arranged in parallel therewith. Various embodiments of the electric switch 3 will now be described in more detail with reference to FIGS. 2–13. FIGS. 2–7 show a first embodiment of the electric switch in which FIGS. 2–4 show it in a first position and FIGS. 5–7 in a second position.

FIG. 2 shows the electric switch in axial section when in a first, closing position. The electric switch comprises a number of flat, circular discs 5, 6 compressed pressed to a stack. The number of discs in the example shown is seven. The discs are divided into a first group 5 and a second group 6, every second disc belonging to respective groups. Each disc 5 in the first group is provided with two peripheral opposing protrusions (not shown). Each protrudes into respective slots in a cylinder 8 surrounding the disks. Each disc 6 in the second group is rigidly connected to a central rod 9 having quadratic cross section.

FIG. 3 shows one of the discs 5 in the first group in lateral view from above. The disc 5 is made primarily of insulating material 11. One part 12 of the disc is made of conducting material. The conducting part 12 extends completely through the disc from one surface to the other, and has the same thickness as the disc. In the example shown the conducting part 12 is in the shape of a partial sector with slightly less than 90° extension. The two projections 7*a*, 7*b* are arranged diametrically at the periphery of the disc. In the centre the disc is provided with a circular hole 10 of sufficient diameter to allow the central quadratic rod 9 to move freely in the hole.

FIG. 4 shows one of the discs 6 in the second group in a lateral view from above. This also consists primarily of insulating material 13 and has a section 14 of conducting material, identical to the equivalent part 12 in the discs of the first group. The disc 6 is also provided with an aperture 15 in the form of a partial sector, with an extension of somewhat more than 90°. The disc 6 has a central hole 16 with quadratic shape of sufficient dimensions corresponding to those of the rod 9 so that a joint determined by shape is obtained between the rod 9 and each disc 6.

In FIG. 2 all the discs are in the positions shown in FIGS. 3 and 4 so that the end surfaces of the conducting parts 12, 14 in each group are in contact with each other in the same plane as the discs abut each other and form a current path represented by the arrows B.

The central rod 9 is connected to a driving power source (not shown) arranged able to rotate the rod 9. Upon rotation of the rod 9 this drive means performs a rotary movement, marked by the arrow A in FIG. 4, in order to drive the discs 6 of the second group. The driving power source is arranged, when necessary, to initiate rotary movement, e.g. when short-circuiting currents appear. Tripping of the driving power source may occur as a result of an increased current strength being sensed. Such sensing and consequential tripping of the drive means may occur in conventional manner and need not be described in further detail in this context.

Figure 6:
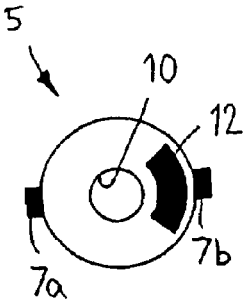
Figure 7:
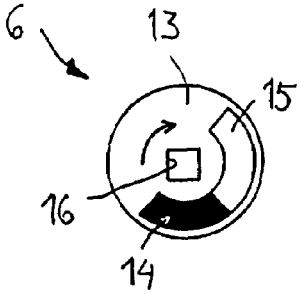
Figure 5:
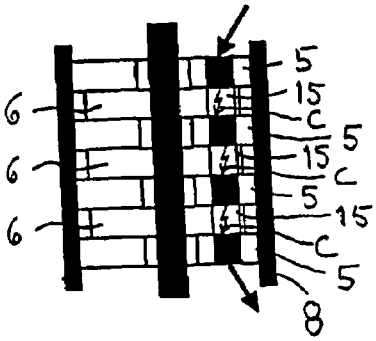
Figure 9:
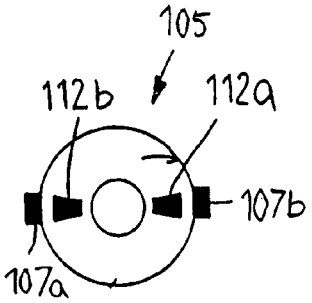
FIGS. 8–13 show a second embodiment of the electric switch in sections/views corresponding to FIGS. 2–7.
Figure 10:
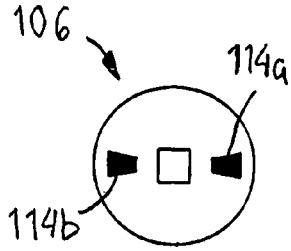
Figure 8:
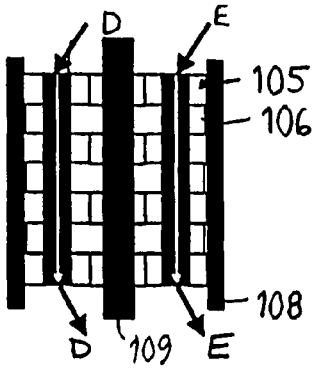

Upon activation of the drive means 9 the driving power source is arranged to turn this so that the electric switch assumes the breaking position shown in FIGS. 5–7, corresponding to a rotation of approximately 90°. As is clear from FIG. 7, the aperture 15 in each disc 6 will be situated opposite the insulating part 12 in each disc 5 so that the conducting part 12 is completely exposed to the aperture 15.

The current path B is thus broken. Each contact plane between discs from different groups will therefore constitute a breaking point where the conducting part 12, 14 of respective discs constitutes a contact member. Each disc thus constitutes a contact element having two contact members, one for the breaking point on each surface. The two outermost discs naturally have only one contact member each.

As can be seen most clearly in FIG. 5, in the resultant breaking position an arc C is produced in each of the apertures 15 in the discs 6 of the second group, each arc extending between the conducting parts 12 in each of the discs 5 in the first group.

FIGS. 8–13 show an alternative embodiment of the electric switch. To a great extent the structure is the same as in the first example and therefore substantially only the differences will be described. Thus, reference signs 105, 106, 107*a*, and 107*b* in FIGS. 8–13 correspond to reference signs 5, 6, 7*a*, and 7*b* in FIGS. 2–7. One difference is that each disc has two conducting parts 112*a*, 112*b* and 114*a*, 114*b*, respectively, which in the closing position shown in FIGS. 8–10 create two parallel current paths, represented by the arrows D and E.

Another difference that the drive means consists of the cylinder 108 cooperating with the discs of the first group, whereas the retaining member consists of the central, quadratic rod 109.

A third difference is that each conducting part 112*a*, 112*b*, 114*a*, 114*b* has considerably less angular extension than each conducting part in the embodiment shown in FIGS. 2–4.

Figure 12:
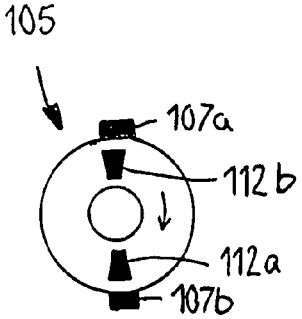
Figure 13:
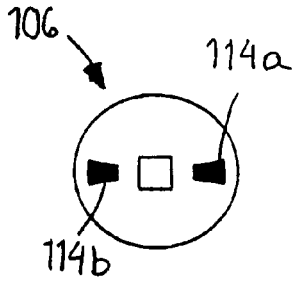
Figure 11:
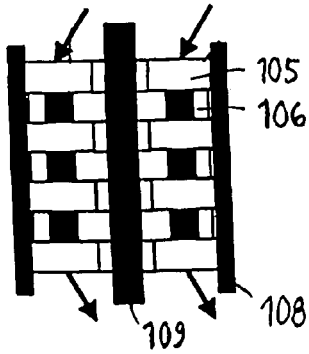

A fourth difference is that neither of the groups has any aperture through the insulating part of each disc. In breaking position, as illustrated in FIGS. 11–13, therefore, the conducting parts of each disc will abut the insulating material in the adjacent discs. In this embodiment the arcs are forced to pass between the insulating surfaces on the discs. The arcs will therefore be "thin" and "wide". The arcs will be cooled extremely well due to their areas being extremely large and the fact that they will be in contact with a solid material that can absorb heat considerably better than a surrounding gas.

Figure 14:
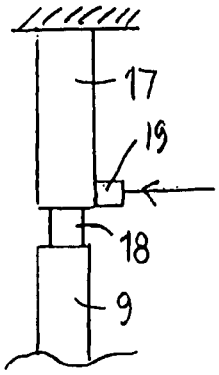
FIG. 14 illustrates a first embodiment of a driving power source for the electric switch.

FIG. 14 shows a first embodiment of how the drive means is connected to a driving power source. In this example the drive means is the quadratic rod 9 in FIG. 2. This is connected at one end to a torsion spring 17, without being able to rotate, via a mechanical coupling member 18. Normally the torsion spring is pre-stressed and locked in its pre-stressed position by a locking device 19. The locking device is arranged, at a signal, to release the locking so that the torsion spring rotates rapidly, i.e. in about 1 ms or less, about 90° and thus via the rod 9 turns the discs of the first group a corresponding angle. The torsion spring wire can naturally also be applied on the embodiment shown in FIGS. 8–13 and caused to operate via the cylinder 108.

Figure 15:
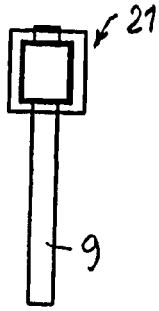
FIGS. 15 and 16 illustrate a second embodiment of a driving power source in accordance with the invention.
Figure 16:
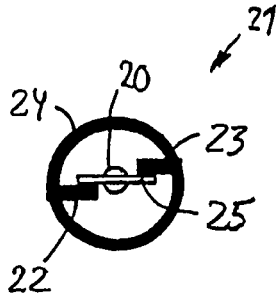

FIGS. 15 and 16 show a second example of how the drive means is connected to a driving power source. The driving power source is in this case based on Thomson coils.

FIG. 15 shows the drive means, i.e. in this case the square rod 9, connected at one end to the driving power source 21. The principle for the driving power source is illustrated in FIG. 16, which is a view from above of FIG. 15. The driving power source comprises two electric coils 22, 23 rigidly mounted on a stationary, cylindrical body 24. A shaft 20 is arranged coaxially with the cylindrical body and constitutes an extension of the square rod 9. A plate 25 of conducting material is connected to the shaft 20 without being able to rotate. The figure shows how the coils 22, 23 and the plate 25 extend substantially along a diametric plane through the cylindrical body 24 during normal operation. Should a short-circuit current be detected, the coils 22, 23 will be excited so that a current flows through them. This creates a strong repulsing power between the coils 22, 23 and the plate 25 so that the latter is rotated clockwise in the figure at high speed an angle of approximately 90°. The shaft 20 is thus turned and with it the square rod 9 so that the electric switch is activated for breaking. A conventional electric motor may alternatively be used as driving power source.

It will be understood that the drive means shown in FIGS. 14–16 can be arranged instead to rotate at the periphery, as shown in FIGS. 8–13.

Figure 17:
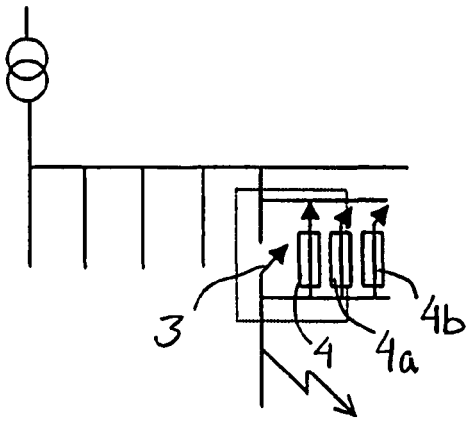
FIG. 17 illustrates a first embodiment of a current limiter in accordance with the invention.

FIG. 17 shows an example of a current limiter in accordance with the invention, in which the commutation circuit comprises a fuse. The electric switch 3 conducts current during normal circumstances. Upon short-circuiting, the electric switch opens and the current commutates over to the fuse 4. Additional fuses 4*a*, 4*b*, etc., are arranged in a revolver arrangement so that when the first fuse 4 has blown and the connection through the electric switch has been restored, a second fuse 4*a* is rotated to its place. The current limiter is then ready for operation again. The invention is naturally also applicable for a fixed fuse.

Figure 18:
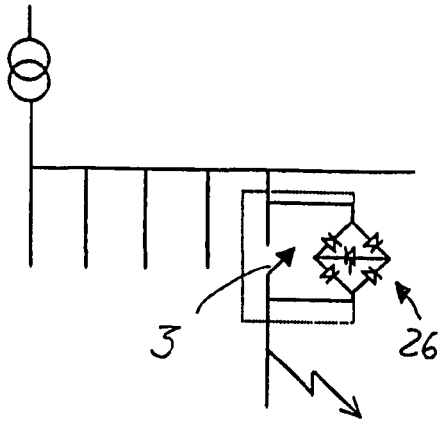
FIG. 18 illustrates a second embodiment of a current limiter in accordance with the invention.

FIG. 18 shows an example of a current limiter in accordance with the invention, wherein the commutation circuit comprises semiconductor components 26, in the present case diodes and thyristors. The dimensioning of semiconductors is dependent on the amplitude of the current to be broken. Systems with high short-circuiting currents require semiconductors that are able to break high currents, which affects the size and cost of the semiconductors. The semiconductors are generally dimensioned for the limited current and not for possible short-circuiting currents, in order to reduce the cost of the semiconductor current limiter. This means that the limited current may not on any occasion reach higher values, which places considerable demands on short-circuit detection and the commutation contact.

Figure 20:
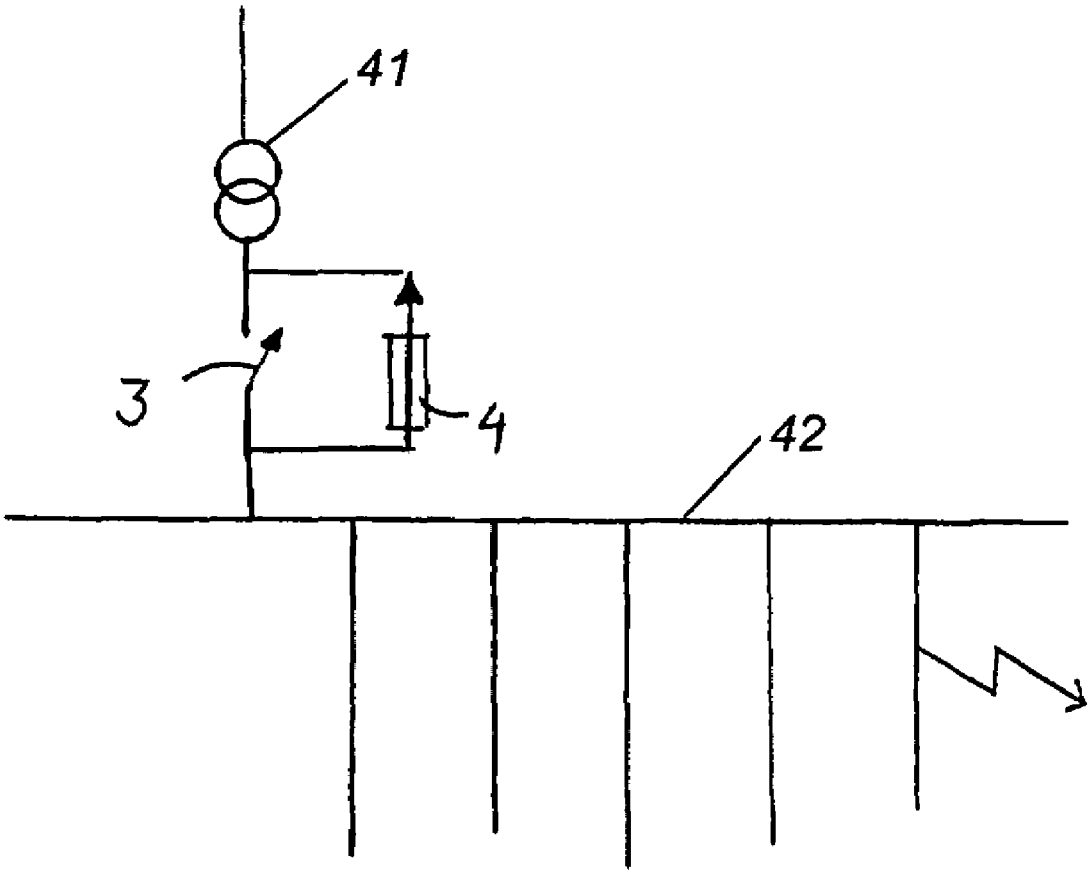
FIG. 20 illustrates an alternative embodiment of an electric power network in accordance with the invention.

The positions of the current limiter illustrated in FIGS. 17 and 18 are only examples. A current limiter of the type claimed can naturally be inserted at other points in the network. e.g. immediately after the transformer 41, before the busbar 42. Such an embodiment is illustrated in FIG. 20.

Comparing fuses with semiconductors, such as thyristors, the prospective short-circuiting current, i.e. the short-circuiting current obtained if no current limitation takes place, is not dimensioned in the same way for a fuse as for a power semiconductor. This is because it always limits the current, as opposed to thyristors which may fail to break, which destroys the thyristors. The result will be a full non-limited short-circuiting current.

Figure 19:
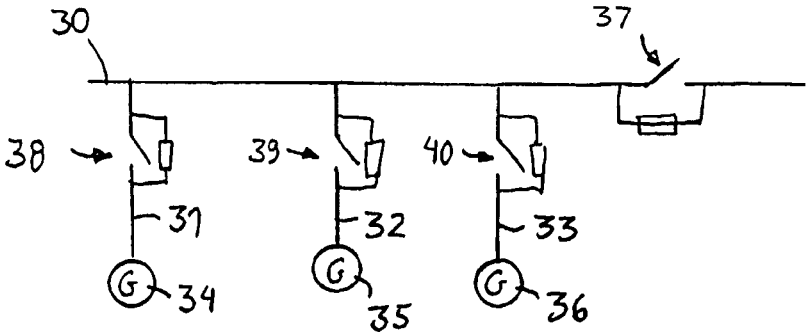
FIG. 19 illustrates an embodiment of an electric power network in accordance with the invention.

FIG. 19 illustrates how an electric power network may be provided with current limiters in accordance with the invention. The example shows a main conductor 30 and three branch conductors 31, 32, 33. Each branch conductor is connected to a generator 34, 35, 36. The main conductor is provided with a current limiter 37 in accordance with the invention. Current limiters 38, 39, 40 are also arranged in each branch conductor. The generators 34, 35, 36 may be generators in an industrial network, wind power generators or generators driven by solar arrays, gas turbines, fuel cells, etc.

Yet another application is connection of large motors to a high voltage network where the short-circuiting effect is already at the limit. Installation of a new motor will increase the short-circuiting effect on the high-voltage network above what it is was dimensioned for since the motor will supply current to the high-voltage network at a short circuit in the high-voltage network. In principle this is the same problem as in distributed generation where generators are installed in a power network previously dimensioned for a certain short-circuiting effect. The new generators increase the short-circuiting effect above the permitted level. In many cases distributed generation requires the installation of current limiters, or for the switchgear to be rebuilt for the new short-circuiting effect-which may be an extremely costly process. In such cases it is often advisable to connect a number of generators to one current limiter, since the effect on each generator is slight.

Figure 21:
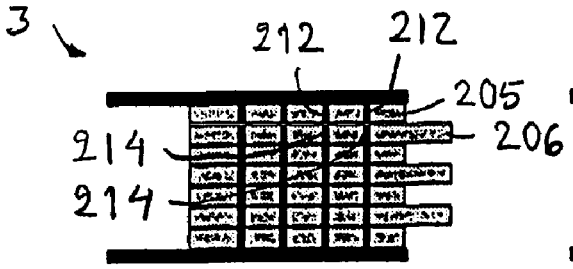
FIGS. 21 and 22 illustrate an alternative embodiment of an electric switch in accordance with the invention in closed and open position, respectively.

FIG. 21 illustrates an alternative embodiment of the electric switch 3. This consists of a number of flat discs 205, 206 compressed to form a stack. In this example also the number of discs is seven and they are divided into a first group 205 and a second group 206, every second disc belonging to respective groups. Each disc is provided with parts 212, 214 of conducting material. In FIG. 21 the electric switch is in a first, closing position in which the conducting part 212 of each disc in the first group 205 is located so that it is in contact with corresponding parts 214 in the second group of discs 206.

Figure 22:
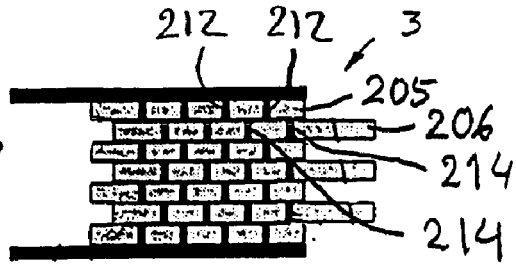

FIG. 22 illustrates the electric switch in FIG. 21 in a second, breaking position. The discs 206 of the second group have been displaced linearly a distance from the position shown in FIG. 21, so that respective groups of discs 205, 206 no longer have their conducting parts 212, 214 in contact with corresponding parts in the adjacent discs.

In conjunction with respective figures the situation is also illustrated symbolically.

Figure 23:
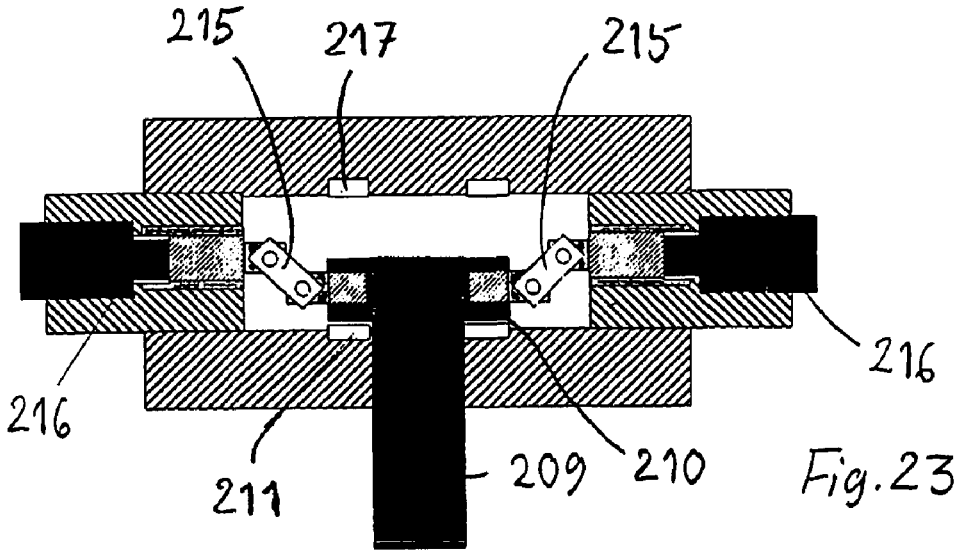
FIGS. 23 and 24 are sections through an actuating mechanism in an electric switch as shown in FIGS. 21 and 22 in closed and open position, respectively.
Figure 24:
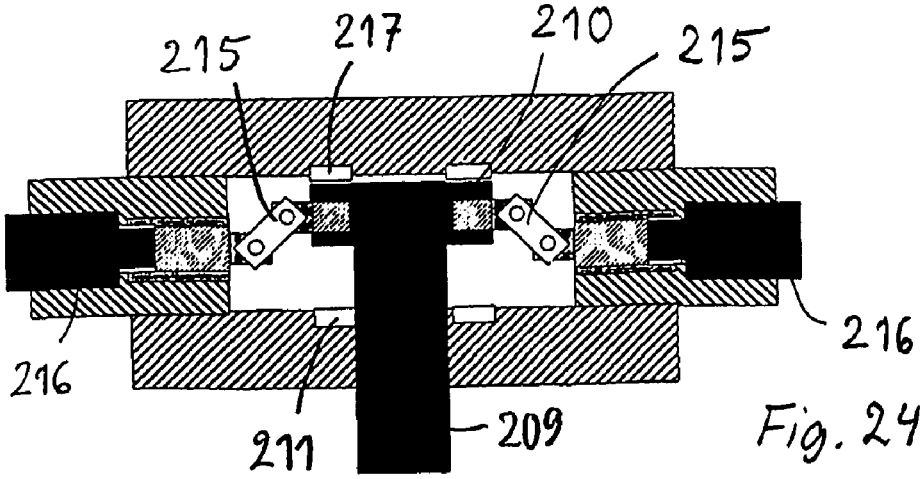

FIGS. 23 and 24 illustrate an example of how the linear movement is effected with the aid of Thomson coils.

In FIG. 23 the electric switch is inclined, as denoted symbolically. An actuating rod 209 is connected to each of the movable contact elements. The actuating rod is provided with a metal armature 210 at the end facing away from the electric switch. In the position illustrated in FIG. 23 this is situated beside a first Thomson coil 211. When the electric switch is to be opened the coil 211 is supplied with current, whereupon a repelling force arises between the coil 211 and the armature 210 so that the armature is quickly displaced upwards to the position shown in FIG. 24. Link mechanisms 215 and springs 216 allow the upward movement.

In the open position illustrated in FIG. 24 the armature 210 is situated close to a second Thomson coil 217. Closing of the electric switch occurs in corresponding manner to opening, by current being supplied to the second Thomson coil 217.

What is claimed is:

1. An electric device comprising an electric switch having a plurality of contact members arranged in series to form a plurality of breaking points arranged in series, at least one of the contact members at each breaking point being movable, and drive means arranged to actuate each movable contact member, which drive means is arranged to effect simultaneous movement of the movable contact members so that simultaneous breaking is achieved at all the breaking points, wherein a commutation circuit is connected in parallel with the electric switch, each contact member constitutes a part of a contact element, which contact elements are arranged in series, a contact surface of each contact element abutting each immediately adjacent contact element, which contact surfaces are substantially flat and parallel, each contact element comprises at least one conducting part and at least one insulating part, the contact elements are divided into a first and a second group of contact elements, so arranged that every second contact element beginning with the first contact element belongs to the first group and every other contact element belongs to the second group, the contact elements of the first group and the contact elements of the second group are arranged movable in relation to each other in planes parallel with the contact surfaces, between a first position in which conducting part(s) of each contact element is/are in contact with conducting part(s) of immediately adjacent contact elements, and a second position in which the conducting part(s) of the first group of contact elements is/are exposed only to the insulating part(s) of immediately adjacent contact elements in the second group, and in that the drive means is arranged to effect a relative movement of the contact elements between said first and second positions.

2. The electric device as claimed in claim 1, wherein the drive means is arranged to impart a simultaneous movement to the contact elements of the first group and in that a retaining means is arranged to keep the contact elements of the second group stationary.

3. The electric device as claimed in claim 2, wherein the movement is a rotary movement and in that each contact element is in the form of a flat, circular disc, the discs being coaxial.

4. The electric device as claimed in claim 3, wherein each of the contact elements in the first group is mechanically joined at the periphery to a drive means common to these contact elements, and each of the contact elements in the second group is mechanically joined at the center to a retaining means common to these contact elements.

5. The electric device as claimed in claim 3, wherein the angle of rotation between the first and the second position is within the interval (180°/n)±20%, where n=the number of conducting parts in a contact element.

6. The electric device as claimed in claim 2, wherein the movement is a linear movement and in that each contact element is in the form of a flat disc.

7. The electric device as claimed in claim 6, wherein each of the contact elements in the first group is mechanically joined to a drive means common to these contact elements and each of the contact elements in the second group is mechanically joined to a retaining means common to these contact elements.

8. The electric device as claimed in claim 3, wherein the insulating part(s) of each contact element in the contact elements in the first and/or second group comprise an opening extending completely through the disc from one surface to the other.

9. The electric device as claimed in claim 3, wherein the number of contact elements is at least five.

10. The electric device as claimed in claim 4, wherein the drive means is connected to a driving power source.

11. The electric device as claimed in claim 10, wherein the driving power source is a mechanical spring.

12. The electric device as claimed in claim 10, wherein the driving power source is an electric motor.

13. The electric device as claimed in claim 10, wherein the driving power source is arranged to effect the movement from the first to the second position in less than 1 ms.

14. The electric device as claimed in claim 1, wherein the number of conducting parts in each contact element is two or more in order to form a plurality of parallel current paths.

15. A current limiter, comprising an electric device as claimed in claim 1.

16. The current limiter as claimed in claim 15, wherein the commutation circuit further comprises a fuse.

17. The current limiter as claimed in claim 16, wherein the fuse is arranged in a magazine holding a number of fuses, which magazine is arranged to automatically replace a burnt-out fuse with an unused fuse.

18. The current limiter as claimed in claim 15, wherein the commutating circuit includes power semiconductor components.

19. A dynamic voltage restorer, comprising an electric device as claimed in claim 1.

20. An electric power network, comprising a current limiter as claimed in claim 15.

21. The electric power network as claimed in claim 20, wherein the network is an industrial network.

22. The electric power network as claimed in claim 20, further comprising:

a plurality of wind-driven generators, solar arrays, gas turbines or fuel cells.

23. An electric power network, comprising a dynamic voltage restorer as claimed in claim 19.

24. The electric device as claimed in claim 3, wherein the angle of rotation between the first and the second position is within the interval (180°/n)±5%, where n=the number of conducting parts in a contact element.

25. The electric device as claimed in claim 10, wherein the driving power source comprises a Thomson coil.

* * * * *